United States Patent [19]

Weeks et al.

[11] Patent Number: 4,501,506

[45] Date of Patent: Feb. 26, 1985

[54] DOT MATRIX PRINT HEAD

[75] Inventors: David E. Weeks, Newfield; John W. Reece; Robert L. Wirth, both of Ithaca, all of N.Y.

[73] Assignee: NCR Corporation, Dayton, Ohio

[21] Appl. No.: 470,012

[22] Filed: Feb. 25, 1983

[51] Int. Cl.[3] ..... B41J 3/12

[52] U.S. Cl. ..... 400/124; 101/93.05

[58] Field of Search ..... 400/124; 101/93.05; 29/469, 428

[56] References Cited

U.S. PATENT DOCUMENTS

| | | | |
|---|---|---|---|
| 4,081,067 | 3/1978 | Schrag et al. | 400/124 |
| 4,185,929 | 1/1980 | Hebert | 400/124 |
| 4,279,518 | 7/1981 | Blomquist et al. | 400/124 |
| 4,279,521 | 7/1981 | Kightlinger | 400/124 |
| 4,300,845 | 11/1981 | Martin et al. | 400/124 |
| 4,365,902 | 12/1982 | Biedermann et al. | 400/124 |

*Primary Examiner*—Paul T. Sewell

*Attorney, Agent, or Firm*—Wilbert Hawk, Jr.; George J. Muckenthaler

[57] ABSTRACT

A wire matrix print head includes a generally circular portion for supporting a plurality of electromagnetic actuators and their associated armatures for driving print wires which are supported and guided in a nose portion of the housing a precise distance from a non-printing to a printing position. The print wire support and guide system is assembled separately from the main body of the print head to facilitate the insertion of the print wires.

3 Claims, 9 Drawing Figures

DOT MATRIX PRINT HEAD

CROSS-REFERENCE TO RELATED APPLICATIONS

Dot Matrix Print Head Solenoid Assembly, copending application Ser. No. 470,011, filed Feb. 25, 1983, invented by Robert L. Wirth, David E. Weeks and John W. Reece, and assigned to NCR Corporation.

Dot Matrix Print Head, co-pending application Ser. No. 470,013, filed Feb. 25, 1983, invented by David E. Weeks, Robert L. Wirth and John W. Reece, and assigned to NCR Corporation.

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical system and which system enables precise control of the impact members.

In the field of dot matrix printers, it has been quite common to provide a print head which has included therein a plurality of print wire actuators or solenoids arranged or grouped in a manner to drive the respective print wires a precise distance from a rest or non-printing position to an impact or printing position. The print wires are generally either secured to or engaged by the solenoid plunger or armature which is caused to be moved such precise distance when the solenoid coil is energized and wherein the plunger normally operates against the action of a return spring.

It has also been quite common to provide an arrangement or grouping of such solenoids in a circular configuration to take advantage of reduced space available in the manner of locating the print wires in that area from the solenoid to the front tip of the print head adjacent the record media. In this respect, the actuating ends of the print wires are spaced in accordance with the circular arrangement and the operating or working ends of the print wires are closely spaced in vertically-aligned manner adjacent the record media. The availability of narrow or compact actuators permits a narrower print head to be used and thereby reduces the width of the printer because of the reduced clearance required at the ends of the print line. The print head can also be made shorter because the narrow actuators can be placed in side-by-side manner closer to the record media for a given amount of wire curvature.

In the wire matrix printer, the print head structure may be a multiple-element type with the wire elements aligned in a vertical line and supported on a print head carriage which is caused to be moved or driven in a horizontal direction for printing in line manner, while the drive elements or transducers may be positioned in a circular configuration with the respective wires leading to the front tip of the print head.

Alternatively, the printer structure may include a plurality of equally-spaced, horizontally-aligned single-element print heads which are caused to be moved in back-and-forth manner to print successive lines of dots in making up the lines of characters. In this latter arrangement, the drive elements or transducers are individually supported along a line of printing. These single wire actuators or solenoids are generally tubular or cylindrically shaped and include a shell which encloses a coil, an armature and a resilient member arranged in manner and form wherein the actuator is operable to cause the print wire to be axially moved a small precise distance in dot matrix printing.

In the concept of dot matrix printing, it is generally desired to place the print element actuators in a position to allow characters to be printed in serial manner and this placement requires that the print wire or like print element actuators be very closely spaced with respect to each other. Since the print actuators are generally much larger in size than the diameter of the printed dot, a relatively long wire or like element must be provided to bring the desired print activity from its source, such as a moving armature or plunger or the like, to a vertical closely-spaced column arranged in a pattern such that the column of closely-spaced, tangentially-coincident dots will be produced on the record media if all actuators are fired or actuated at one time.

Representative documentation in the field of wire matrix print heads includes U.S. Pat. No. 3,994,381, issued to D. G. Hebert on Nov. 30, 1976, which discloses a wire matrix print head having a plurality of print wires with input ends arranged in an elliptical format and supported and guided at several points by means providing for a minimal amount of bending along the length of the wires.

U.S. Pat. No. 4,051,941, issued to D. G. Hebert on Oct. 4, 1977, discloses a matrix print head with guide means at several points for the print wires which are operably associated with armatures actuated by electromagnetic structures.

U.S. Pat. No. 4,185,929, issued to D. G. Hebert on Jan. 29, 1980, discloses a print head assembly with relatively long length and short length bearing and guide members to provide continuous wire passage and to enable uninterrupted slidable insertion of the print wires during assembly.

U.S. Pat. No. 4,230,038, issued to D. G. Hebert on Oct. 28, 1980, discloses a print head assembly having a housing of molded plastic with print wire guide and support means of axially-spaced plate members at several points and with apertures for containing the wires in an elongated path.

U.S. Pat. No. 4,230,412, issued to D. G. Hebert on Oct. 28, 1980, discloses a print head assembly having an elongated wire guide and support portion and an annular housing portion along with a cover portion for the armature members.

And, U.S. Pat. No. 4,279,518, issued to J. E. Blomquist et al. on July 21, 1981, discloses a dot matrix print head with a single unit coil assembly which can be removably placed as a unit among pole pieces and yoke members, along with a supporting arrangement which automatically aligns the clapper of each coil assembly with the impact end of a print wire. Also disclosed are novel assembly aids and procedures which simplify and hasten the assembly of the print head and including the use of assembly aids for inserting the print wires into the several wire guide members.

SUMMARY OF THE INVENTION

The present invention relates generally to impact printing devices for dot matrix printing wherein at least one print wire or needle is caused to be propelled against a printing medium or like record media by an associated clapper-type, solenoid-actuated, print wire driver for printing dot matrix characters in accordance with external control signals which cause energization of the driver coil and movement of the print wire for enabling printing of the characters. More particularly, the present invention relates to an improved wire matrix print head having a plurality of actuators or drivers positioned for respective print wires and wherein each actuator coil is energized to cause an associated armature or clapper which is engaged with a print wire to propel such print wire or needle a precise distance to mark or print a dot on the record media.

The print wire actuators are arranged in a circular configuration adjacent the print head housing and each of the actuators is associated with the clapper-type armature, in turn engageable with the actuating end of the print wire. The several print wires are arranged to conform with the circular configuration of the print wire actuators at the actuating ends of the print wires and are guided along separate paths to the nose portion of the print head wherein the operating ends of the wires are disposed in a closely-spaced single column so as to effect dot matrix printing.

The system for supporting and guiding the print wires includes a rear guide, a bridge guide and a tip guide wherein the rear guide and the bridge guide are initially assembled to form a subassembly. This subassembly is formed to easily and conveniently receive the print wires and such subassembly is then assembled with the tip guide by means or with the aid of a tool or fixture to facilitate entry of the print wires into proper sequence into the tip guide. The subassembly of print wires in the rear guide and in the bridge guide along with the inserted print wires in the tip guide are then easily installed into the housing of the print head.

In view of the above discussion, the principal object of the present invention is to provide means for simplifying the assembly of a wire matrix print head.

Another object of the present invention is to provide a wire guide system for assembling together the several parts of a print head.

An additional object of the present invention is to provide a wire guide system that is assembled separate from the main body of the print head to facilitate insertion of the print wires in the assembly process.

A further object of the present invention is to provide fixture means for assembly of certain parts of the print head without manual manipulation of the print wires during insertion thereof in the wire guide assembly.

Additional advantages and features of the present invention will become apparent and fully understood from a reading of the following description taken together with the annexed drawing.

DESCRIPTION OF THE PREFERRED EMBODIMENT

Figure 1:
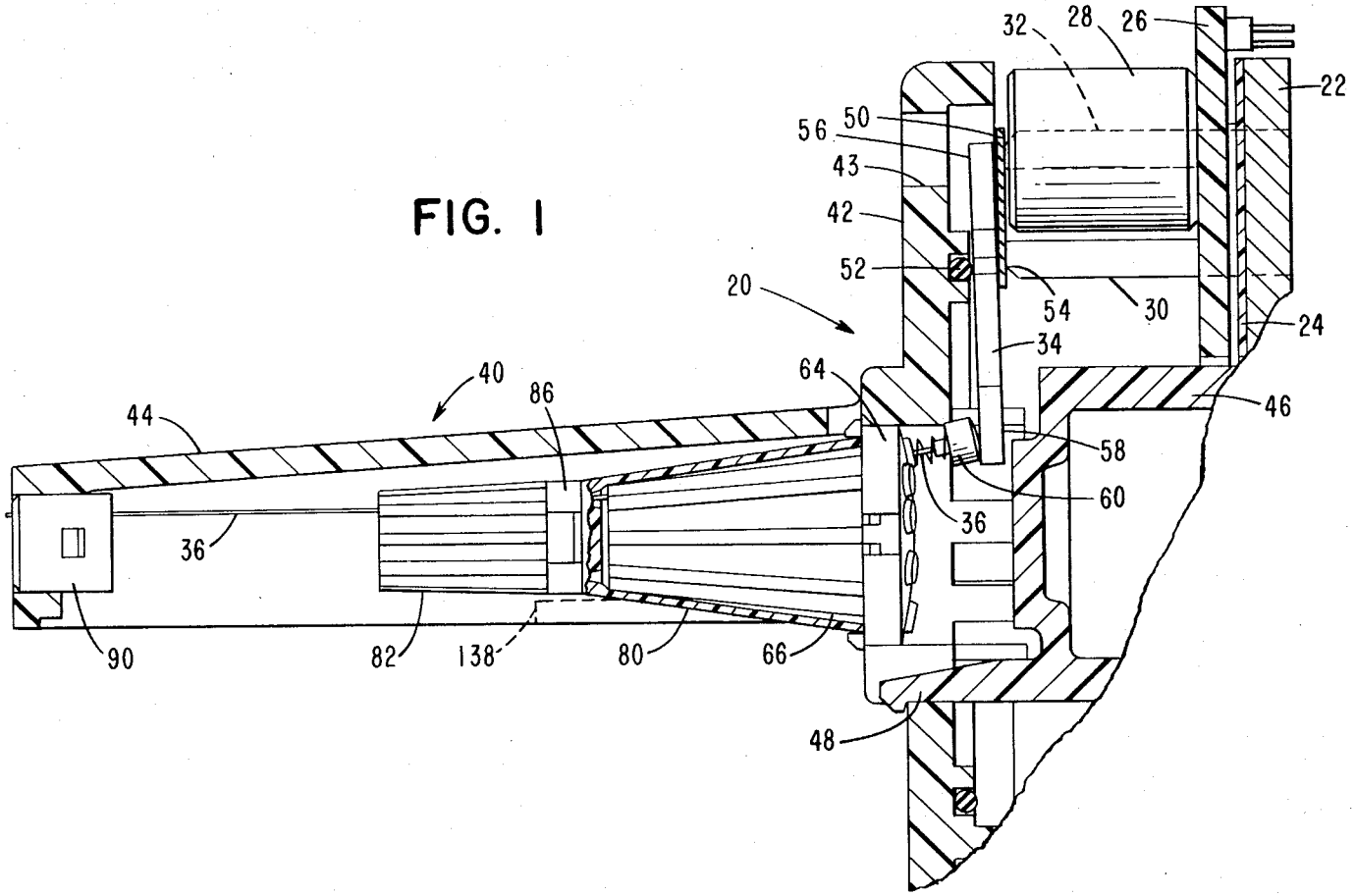
FIG. 1 is a side elevational view, partially in section, of a portion of a dot matrix print head incorporating the subject matter of the present invention.

Referring now to the drawing, FIG. 1 shows a sectional view of a portion of a dot matrix print head, generally designated as 20, and which includes a metallic back plate 22 of circular shape along with an insulating spacer 24 of generally circular shape and a printed circuit board 26 forward of the back plate and the spacer. A plurality of electromagnets or solenoids 28 are operably connected with and supported from the circuit board 26 in a manner wherein the magnetic core members or pole pieces 30 and 32 thereof are supported and positioned for operation with respective armatures or clappers 34 to drive print wires 36 in printing operation. The details of construction of the solenoid coils of such electromagnets 28 and the printed circuit board 26 are disclosed in the above-mentioned co-pending application, Ser. No. 470,011.

A front housing, made of non-metallic material such as polycarbonate or the like and generally designated as 40, includes a circular flange portion 42 integral with an elongated nose portion 44 and formed to be secured with the back plate 22 by means of a fastener member 46 which has three fingers, as at 48, engaging with the front surface of the flange portion for securing the respective parts between the plate 22 and the flange portion 42 in assembled manner. The flange portion 42 includes a plurality of apertures 43 spaced in a circle and corresponding with the end of the armatures 34 opposite the respective electromagnets 28 for manually testing operation of the armatures. The housing nose portion 44 contains and supports the print wires 36 in precise manner for the small back-and-forth distance traveled by such wires during printing operations. The details of construction of the fastener member 46 are disclosed in the above-mentioned co-pending application, Ser. No. 470,013.

An insulating film or residual spacer 50 is placed between the front end of the electromagnets 28 and the armatures 34. The armatures 34 are biased against the film by an O-ring 52 and the armatures are each caused to pivot on an edge 54 of the inner magnetic core member or pole piece 30 of its associated electromagnet. The outer end 56 of the armature 34 is positioned to be operated by the electromagnet 28 and the inner end 58 of the armature is engaged with a head portion 60 of the print wire 36. The print wire 36 is made of tungsten and the head portion 60 is made of glass-filled nylon and formed securely over an end loop or pigtail of the print wire.

Figure 2:
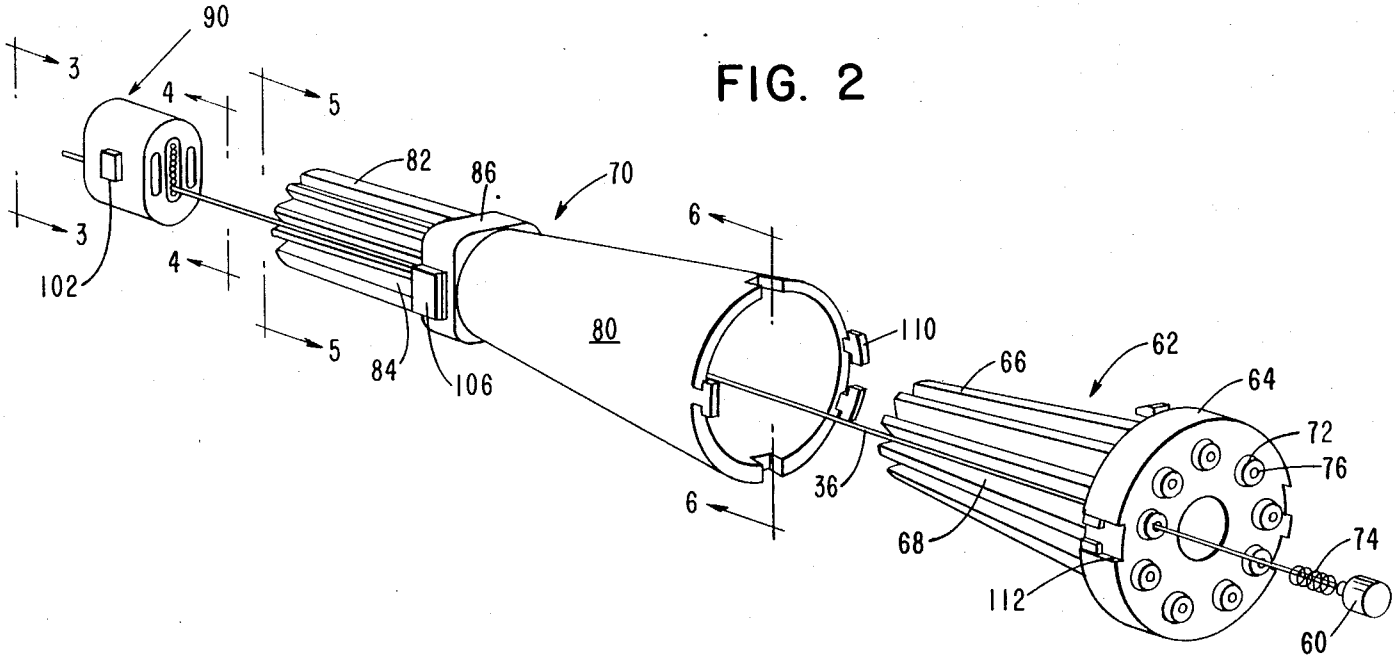
FIG. 2 is a perspective view showing certain parts of the print head in exploded manner.

As seen in FIG. 2, the print wire guide means for the print head 20 includes a first guide member 62 which has a circular-shaped rear portion or spring seat 64 with a grooved portion 66 integral therewith. The portion 66 defines a circular-to-elliptical shaped member and has elongated grooves 68 running lengthwise thereof for receiving and for carrying the print wires 36 in respective paths from the rear portion 64 to a second guide member or wire guide bridge 70 during assembly. The rear portion 64 has a plurality of raised pads 72 on the rear surface thereof for providing a seat for each return compression-type spring 74 wrapped around the respective print wire 36 and adjacent the plastic head portion 60. An aperture 76 is formed through each of the pads 72 and through the circular rear portion 64 for receiving the print wires 36 and for directing the wires to the respective grooves 68 in the elongated portion 66.

The second guide member 70 includes a smooth conical-shaped, elongated portion 80 of hollow construction for receiving the grooved portion 66 of the first guide member 62. The guide member 70 also includes a grooved portion 82 of reducing-elliptical shape and having elongated grooves 84 running lengthwise for receiving and for carrying the print wires 36 in respective paths from the portion 66 and from a mid-portion 86 of the guide member 70. The mid-portion 86 has apertures 88 (FIG. 5) therein to provide passageways for the print wires 36.

Figure 3:
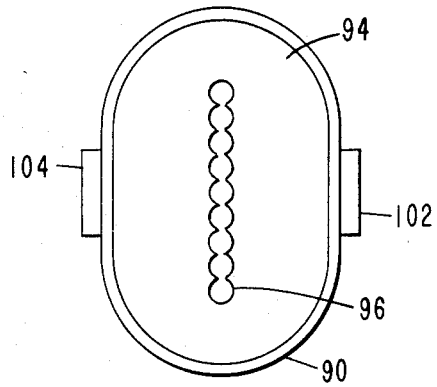
FIG. 3 is an enlarged view taken along the plane 3—3 of FIG. 2.
Figure 4:
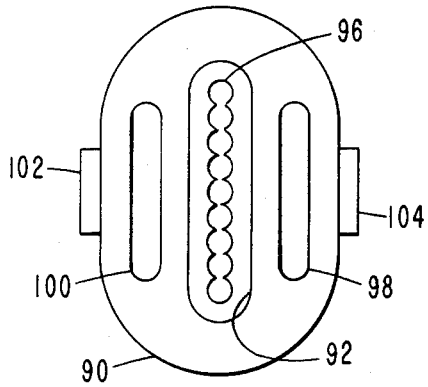
FIG. 4 is an enlarged view taken along the plane 4—4 of FIG. 2.

A third guide member or wire tip guide 90 of generally oval or elliptical configuration, as also seen in FIGS. 3 and 4, is positioned and formed to fit within the front of the nose portion 44 of the housing 40 (FIG. 1). A pair of felt pads may be placed adjacent the print wires 36 in the space just rearward of the member 90 after such member is fitted in position within the front of the nose portion 44. The guide member 90 is substantially solid in construction and has a forwardly extending tapered rear slot 92 (FIG. 4) partially through and connecting or blending with a plurality of connecting apertures 96 for receiving the print wires 36. A pair of rear slots 98 and 100 (FIG. 4) are also disposed in the guide member 90 on either side of the slot 92 and a pair of ears or tabs 102 and 104 are provided for latching the member 90 in suitable corresponding insets or grooves (not shown) in the sides of the front part of the nose portion 44. (Slots 98 and 100 provide for a certain amount of flexibility in the rear portion of the member 90 to aid in assembly of the parts.

Figure 5:
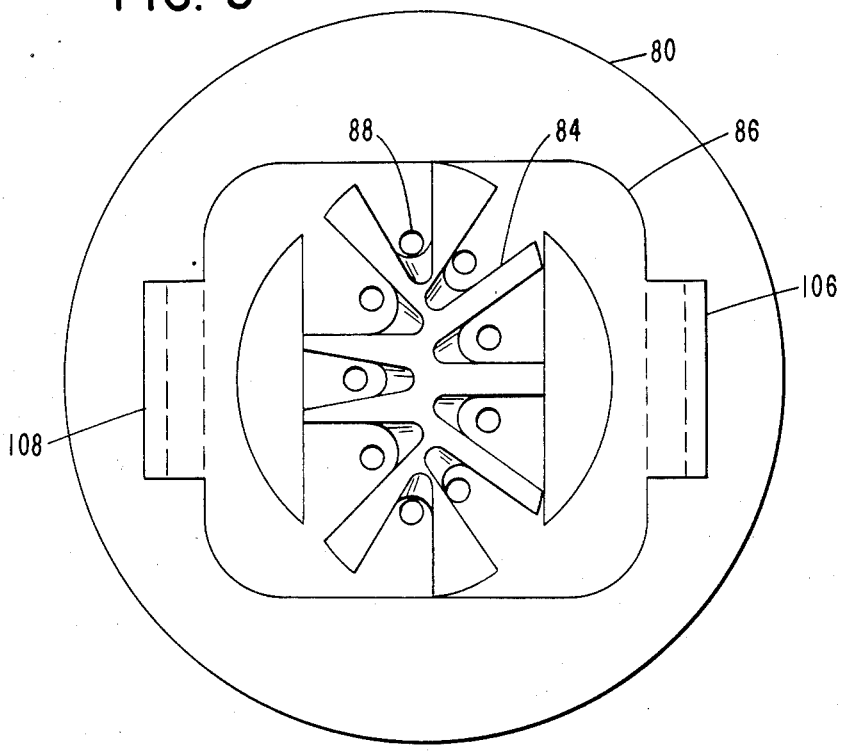
FIG. 5 is an enlarged view taken along the plane 5—5 of FIG. 2.
Figure 6:
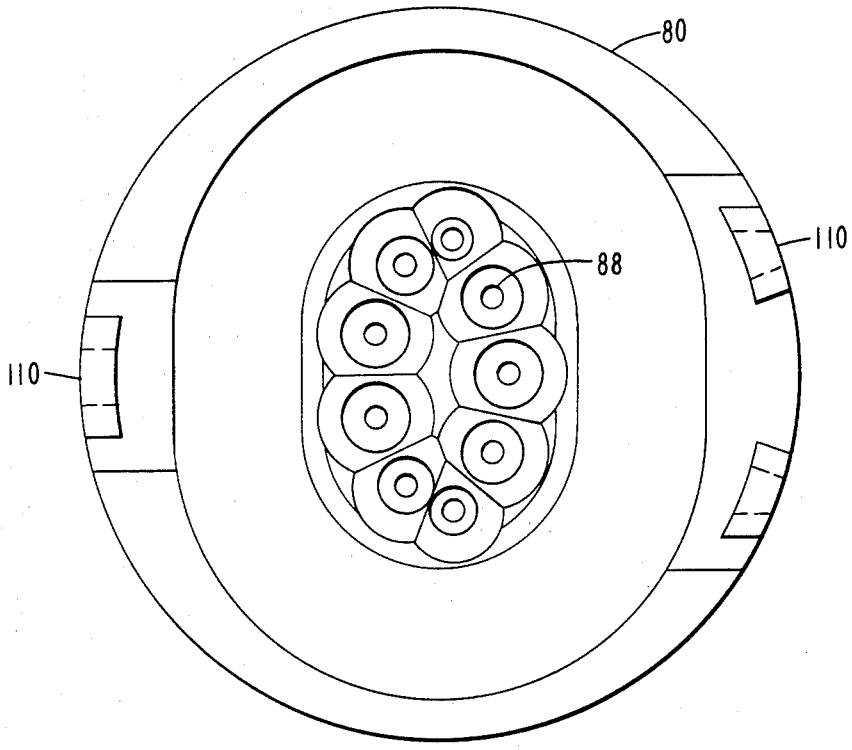
FIG. 6 is an enlarged view taken along the plane 6—6 of FIG. 2.

The mid-portion 86 also has ears or tabs 106 and 108, as seen in FIG. 5, for latching the guide member 70 in suitable insets or grooves (not shown) in the nose portion 44, and further the elongated portion 80 of the guide member 70 includes T-shaped tabs 110 (FIG. 2) for engaging or inserting in corresponding grooves 112 provided in the periphery of the rear portion 64 of the first guide member 62. It is seen that the respective guide members 62, 70 and 90 are secured within the nose portion 44 of the housing 40, as illustrated in FIG. 1, and are formed to direct the print wires 36 in a path from the circular configuration of the apertures 76 in the rear portion 64 to the oval or elliptical configuration, as seen in FIG. 6, and then to the aligned configuration as represented by the line of connecting apertures 96, as seen in FIGS. 3 and 4.

Figure 7:
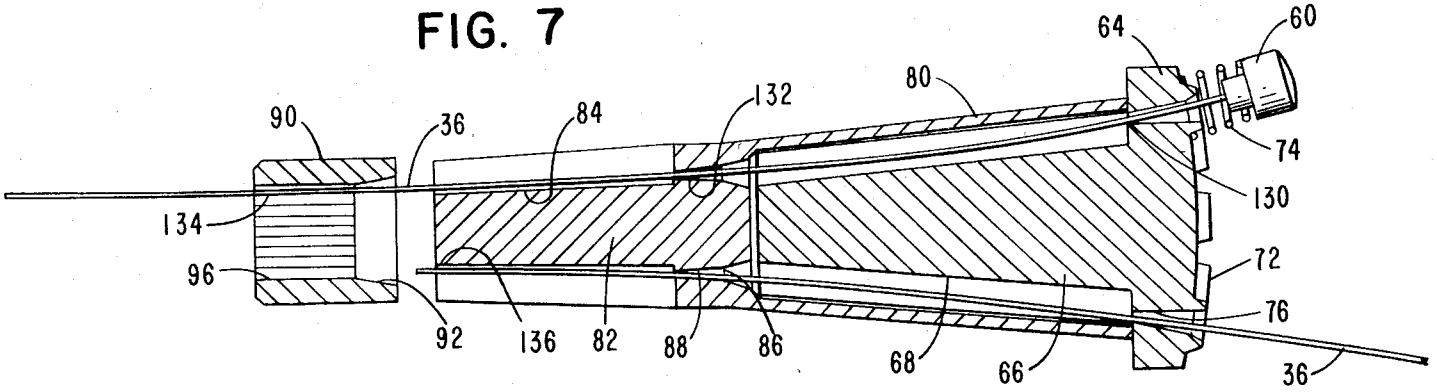
FIG. 7 is a side elevational view, partially in section, showing the assembly of the several guide members with print wires therethrough.

In the assembly of the print head 20, the most time-consuming and delicate operation is that of inserting the forward ends of the print wires 36 in precise and proper locations in the nose portion 44 of the housing 40. As seen in FIG. 7, the print wires 36 are first inserted through the respective apertures 76 of the rear portion 64 and then are directed by the grooves 68 of portion 66 to and through the apertures 88 in the mid-portion 86 (FIGS. 5 and 6). The wires are then directed in respective paths by the grooves 84 in the portion 82 and are desired to be formed in an aligned formation for entering the slot 92 (see also FIG. 4) and ultimately the apertures 96 of the guide member 90. While the print wires 36 tend to converge or cross at a point approximately one-quarter inch in front of the grooved portion 82 after passing the forward ends of the print wires therethrough, it is advantageous to contain or hold the print wires in an aligned formation to complete the assembly of the wires within the guide members 62 and 70 and through the apertures 96 of the front guide member 90.

Figure 8:
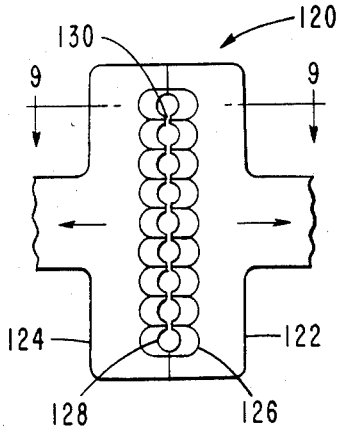
FIG. 8, on the sheet with FIG. 6, is a view of a fixture useful for insertion of the print wires.
Figure 9:
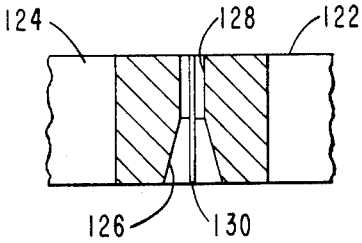
FIG. 9, on the sheet with FIG. 6, is a view taken along the plane 9—9 of FIG. 8.

A fixture or tool 120 (FIG. 8) is useful for containing or holding the print wires 36 in the aligned formation for insertion or installation in the guide member 90 and, as seen in FIGS. 8 and 9, includes opposed movable members 122 and 124 having elongated, conical-shaped grooves 126 formed for a distance through such opposed members and then having round grooves or passageways 128 formed for the remaining distance through the members, such round grooves being separated by a gap 130 therebetween.

Following insertion of the print wires 36 within and along the respective grooves 68 and 84 of the guide members 62 and 70 (FIG. 2), the wire tip guide member 90 is caused to be installed over the front ends of the print wires with or without the aid of the fixture or tool 120. The wire guide assembly, comprising a subassembly of the print head 20, is then installed into the nose portion 44 (FIG. 1) of the housing 40 and latched in place. In this manner of assembly of the print head 20, the somtimes difficult task of inserting the print wires 36 in the support and guide system is easily completed as a subassembly separate from the main housing and is then easily installed in the housing 40 after which the other operating parts are assembled to the housing and latched by the fastening member 46 to secure the operating parts in the space between the back plate 22 and the flange portion 42 of the housing.

As seen in FIG. 7, the support and guide means for the print wires 36 include the primary support point 130 in the rear portion 64, support point 132 in the mid-portion 86, and point 134 in the guide tip 90, which points hold each of the respective print wires in its curved shape within the nose portion 44 of the housing 40. A support point 136 is effective during printing operation wherein impact causes the print wire to tend to buckle inward toward the center line of the housing nose portion 44. The funnel shape of the apertures 76 and 88 and the slots or grooves 68 and 84 enable the print wires 36 to be guided through the rear and mid portions 64 and 86 without precise manual manipulation of the wires to direct same toward and through the bridge 70. The print wires 36 are inserted through the apertures 96 of guide tip 90 and the subassembly is then installed in the housing 40. When the assembly of the print head 20 is completed, the head is secured to a printer by means of an apertured flange 138 (FIG. 1) on each side of the nose portion 44.

The spring seat or rear portion 64, along with the first guide member 62, the second guide member 70 and the wire tip guide 90 are made of lubricated acetal or like material to provide suitable bearing surfaces for smooth operation of the print wires 36.

It is thus seen that herein shown and described is a wire matrix print head that includes print wires support and guide members which are formed to provide for simplifying the assembly of the print head. The method of assembling the print wires in the housing is considered adaptable for automatic working to enable ease of installation in the overall print head assembly. The method and apparatus of the present invention enables the accomplishment of the objects and advantages mentioned above, and while a preferred embodiment has been disclosed herein, variations thereof may occur to those skilled in the art. It is contemplated that all such variations not departing from the spirit and scope of the invention hereof are to be construed in accordance with the following claims.

We claim:

1. A wire matrix print head comprising a mounting plate having a plurality of electromagnets supported therefrom in a circular arrangement, an annular housing portion and a nose portion integral therewith, a plurality of print wires each having one end thereof originating in the housing portion and supported within the nose portion and each having the other end thereof terminating at the end of said nose portion, a plurality of armatures operably associated with the electromagnets and with said one ends of the print wires for driving the other ends of the print wires from a non-printing to a printing position, and print wire guide means of generally conical shape and extending from the annular housing portion to a point approximately midway of the nose portion and including a first guide member having an annular portion formed for bearing said one ends of the print wires and having a grooved forward portion integral therewith and formed for directing the wires from a circular to an elliptical pattern and insertable into a second guide member of the guide means, said second guide member including a rearward hollow portion for receiving the grooved forward portion of the first guide member and having a grooved forward portion formed for directing the wires from the elliptical pattern to an aligned configuration, said first and second guide members forming a wire guide subassembly having the print wires contained therein and arranged for fitting into the nose portion of the print head, said guide means further including a tip portion for receiving the other ends of the print wires in aligned manner in the assembly of the print head and for supporting the other ends in printing operation.

2. A method of assembling a wire matrix print head having means operably associated with and supporting a plurality of electromagnets in a circular arrangement for driving print wires positioned within a nose portion of the print head from a non-printing to a printing position, comprising the steps of providing a first guide member for receiving and bearing a plurality of print wires in a circular configuration and directing the print wires into an oval configuration, providing a second guide member for directing the print wires from the oval configuration into an aligned pattern, inserting the first guide member into the second guide member to form a wire guide subassembly, holding the print wires in the aligned pattern, providing a third guide member for receiving the aligned print wires, and inserting the subassembly of the first and the second guide members along with the third guide member containing the print wires therein arranged as a wire guide assembly and latching thereof into the nose portion of the print head with the ends of the print wires placed in printing position.

3. In a wire matrix print head having a frame member, a plurality of electromagnets supported in a circular arrangement from the frame member and operably associated with a plurality of print wires positioned within a nose portion of the print head for driving the wires from a non-printing to a printing position, the improvement comprising print wire guide means including a first guide member having a rearward annular portion for receiving and bearing one end of the print wires in circular configuration and including a forward grooved portion integral therewith for directing the wires into an elliptical configuration, a second guide member having a hollow rearward portion for receiving the grooved portion of the first guide member and having a forward grooved portion integral therewith and at one end thereof for directing the print wires into an aligned configuration, and a third guide member for receiving and holding the aligned print wires, wherein said first guide member is inserted into the second guide member to form a subassembly and along with the third guide member with the print wires in printing position therein is inserted as a wire guide assembly into the nose portion of the print head for containment thereby.

* * * * *